US006609628B2

(12) United States Patent
Tattam

(10) Patent No.: US 6,609,628 B2
(45) Date of Patent: Aug. 26, 2003

(54) COLLAPSIBLE TRANSPORT CONTAINER

(75) Inventor: Edwin Francis Tattam, Magpies, Grubbins Lane, Speen, Bucks, HP27 0SH (GB)

(73) Assignee: Edwin Francis Tattam, Bucks (GB)

( * ) Notice: Subject to any disclaimer, the term of this patent is extended or adjusted under 35 U.S.C. 154(b) by 0 days.

(21) Appl. No.: 09/842,979

(22) Filed: Apr. 27, 2001

(65) Prior Publication Data

US 2001/0030194 A1 Oct. 18, 2001

Related U.S. Application Data

(63) Continuation-in-part of application No. 09/508,756, filed as application No. PCT/GB99/02225 on Jul. 12, 1999, now Pat. No. 6,234,341.

(30) Foreign Application Priority Data

Jul. 17, 1998 (GB) ..... 9815474
Apr. 20, 2001 (GB) ..... 0109764

(51) Int. Cl.[7] ..... A47J 39/00

(52) U.S. Cl. ..... 220/592.26; 220/666; 220/6; 220/592.25

(58) Field of Search ..... 220/666, 6, 592.26, 220/592.25, 62.22, 62.13, 588, 4.28, 1.5, 23.87, 23.91

(56) References Cited

U.S. PATENT DOCUMENTS

| | | | | |
|---|---|---|---|---|
| 2,803,368 A | | 12/1957 | Koch | |
| 3,139,206 A | | 6/1964 | Matsch | |
| 3,472,568 A | | 10/1969 | Southwick | |
| 3,888,557 A | | 6/1975 | Anderson et al. | |
| 4,377,075 A | | 3/1983 | Russo | |
| 4,700,862 A | * | 10/1987 | Carter et al. | 220/6 |
| 4,862,674 A | | 9/1989 | Lejondahl et al. | |
| 5,009,952 A | | 4/1991 | Klepsch et al. | |

FOREIGN PATENT DOCUMENTS

| | | |
|---|---|---|
| DE | 3743372 A | 6/1989 |
| EP | 0157751 A | 10/1985 |
| FR | 2419884 A | 10/1979 |
| GB | 610559 A | 10/1948 |
| GB | 1403771 A | 8/1975 |
| GB | 1482325 A | 8/1977 |
| GB | 2235523 A | 3/1991 |
| GB | 2262155 A | 6/1993 |
| WO | WO 80/01791 A | 9/1980 |

* cited by examiner

*Primary Examiner*—Stephen Castellano
(74) *Attorney, Agent, or Firm*—Fleshner & Kim, LLP

(57) ABSTRACT

A transport container is provided that includes a rigid liner collapsible in a direction transecting a vertical axis of the container, such that the container is configurable between a non-collapsed state configured to hold transportable contents therein, and at least partially collapsed state configured for compact storage of the container when empty an elastic insulation means configured to surround the liner, and one of more rigid insulating plugs configured for insertion inside the liner when the container is in its non-collapsed state. Such a transport container is easy to store when empty, can be composed of materials that can be recycled, and may have components that are easy to manufacture and to assemble. The container may possess a space efficient outer shape when full of transportable products, so that the number of containers that can be transported per given transit space may be maximized.

19 Claims, 5 Drawing Sheets

COLLAPSIBLE TRANSPORT CONTAINER

This application is a continuation-in-part of Ser. No. 09/508,756 filed Mar. 16, 2000 now U.S. Pat. No. 6,234,341, which is a 371 of PCT/GB99/02225 filed Jul. 12, 1999.

BACKGROUND OF THE INVENTION

1. Field of the Invention

The present invention relates to a transport container for use in safely transporting products.

2. Background of the Related Art

Some products are temperature sensitive and hence may require either being kept cool or being protected from chilling during transit. Further, transported products also need generally to be protected from physical shock. The present invention also relates to a transport container for transporting such sensitive products (e.g. laptop computers).

In addition, the container of the present invention is constructed such that it can be collapsed into a space saving, flattened configuration when empty, and hence can be easily stored and moved prior to, or after, holding any transportable contents. Moreover, the collapsible container of the present invention is typically constructed of materials that can be recycled and thus are ecologically friendly.

Examples of products that need to be kept cool whilst being transported from place to place, for example by postal or courier services (particularly from a manufacturer or distributor to a consumer), include frozen food products, pharmaceutical and biochemical products (including diagnostic agents), and organs for transplantation.

Examples of products that, by contrast, need instead to be protected from chilling during transport (particularly, for example, from freezing as part of air cargo), include heated foodstuffs and further pharmaceutical products, as well as blood products.

Both types of goods conventionally have been transported in thermally insulated, rigid containers such as boxes fabricated of polystyrene foam. However, polystyrene boxes can be fragile and are expensive to manufacture, as well as being space-inefficient.

As an alternative, the applicant's co-pending International Patent Application No. PCT/GB99/02225 (published as WO 00/03931) describes an improved transport container that comprises an insulating block and a plurality of layers of flexible insulating foam material forming sides of the container. The plurality of layers are mounted on the block, which closes one end of the container, and an outer pressure envelope is also provided to apply pressure around the exterior of the sides and the block. Although, such a container can be made of materials that can be recycled, and is therefore more environmentally friendly as compared to polystyrene boxes, disadvantageously this prior container is still bulky and thus difficult to store when not being used to transport products.

French Patent Application No. 7808251 (published as FR-A-2419884) discloses a rigid container comprising sides having at least two layers of sheets of plastic material laminated with metal, which provide thermo-insulation of any contents. However, because the sheets are metallized, the container cannot be collapsed and remains in a bulky, non-collapsed state even when no contents are held.

SUMMARY OF THE INVENTION

It is hence an aim of the present invention to overcome the above mentioned disadvantages of these prior containers, by providing a transport container that is both compact to store when empty, may be composed of materials that can be recycled, and whose components are also easy to manufacture and to construct.

It is a further aim that the container should also provide a space efficient outer shape when full of transportable products, so that the number of containers that can be transported per given transit space may be maximized.

Thus, a transport container according to an embodiment of the invention includes

- a rigid liner collapsible in a direction transecting the vertical axis of the container, such that the container is configurable between a non-collapsed state (for holding transportable contents therein) and an at least partially collapsed state (for compact storage when empty);
- an elastic insulation means surrounding the liner; and
- one or more rigid, insulating plug(s) for insertion inside the liner when the container is in its non-collapsed state.

The liner provides a means for altering the shape of the container between collapsed and non-collapsed configurations, whereas the surrounding insulator provides the container with appropriate additional thermal and physical protective insulation properties. Goods can be stored safely inside the non-collapsed liner, which is kept in such a configuration by one or more plug(s), once the latter have been inserted.

Tension in the container's sides helps to provide rigidity, the latter property being important to insulate the contents from physical shocks. Further, because the insulation means is elastic, the entire container can collapse when the plugs are removed, allowing the container to be compactly stored when empty. The partially collapsed container can then be further flattened.

To keep a product as cold as possible during transit, the pre-chilled product may be placed inside the non-collapsed container together with a desired quantity of "dry ice" in granulated, sliced or chunk form.

However, if the product is only required to be kept moderately cool (but not frozen) or indeed warm, instead of surrounding the product with "dry ice", a separate sealed bag containing a refrigerant, or warmed liquid, respectively, can be placed inside the container together with the product.

The insulator means preferably comprises a plurality of layers of flexible material, so as to increase its thermal and physical insulation properties.

Before and after the container has been used for transporting the goods, the plug(s) can be removed, as mentioned above, allowing the container to be flattened by an operator into its space saving, collapsed configuration. In this way, multiple flattened containers can be stored or transported without taking up substantial room.

In a second aspect, the present invention provides a kit for assembling a collapsible transport container as described above comprising:

- at least one of said liners, each being surrounded by said insulation means;
- at least one of said plug(s); and
- at least one pressure envelope.

The pressure envelope may be used, in an assembled container, to apply pressure around the exterior of the sides of the container.

The components of such a kit can easily be manufactured and assembled according to the present invention, which provides a method of either constructing such a transport container, or assembling the kit, including the steps of:

placing the liner in its collapsed state around a flat mandrel;

winding a plurality of layers around the outside of the liner;

removing the partially constructed container from the mandrel;

bonding (for example, heat shrinking) at least part of a pressure envelope around the outside of the plurality of layers with the liner still in its collapsed state;

opening the liner into its non-collapsed state;

inserting at least one plug inside the liner to maintain the non-collapsed state of the container; and bonding (for example, heat shrinking) at least another part of the pressure envelope to the at least one plug.

Thus, in one embodiment, the fully constructed container has an optional pressure envelope that, when present, is preferably bonded (in separate stages) to both the outermost of the plurality of layers of the elastic insulation means and to the at least one plug. In this way, such a container provides a simple and effective way of very securely sealing the contents inside, since the envelope's pressure increases the tensioning of the container walls. Further, sealing the container involves no use of tapes and so forth that can become unstuck and that are often tricky to apply or re-apply.

Furthermore, by sealing a complete outer envelope around such a container, the latter is provided with a tamper evident security feature which can easily be monitored.

BRIEF DESCRIPTION OF THE DRAWINGS

The present invention will now be described in greater detail by reference to the following non-limiting example as illustrated in the accompanying drawings, in which.

DETAILED DESCRIPTION OF THE PREFERRED EMBODIMENT

Figure 4A:
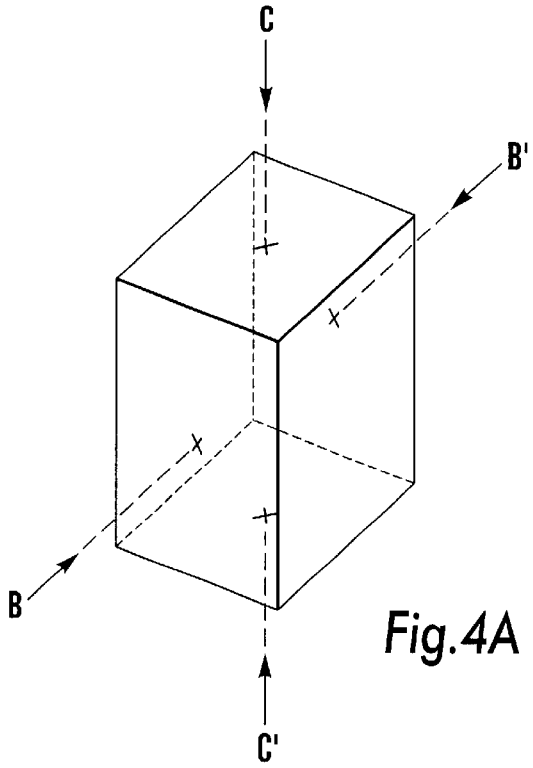
FIG. 4A illustrates the container of FIG. 3C with the envelope fully sealed around the container.
Figure 4B:
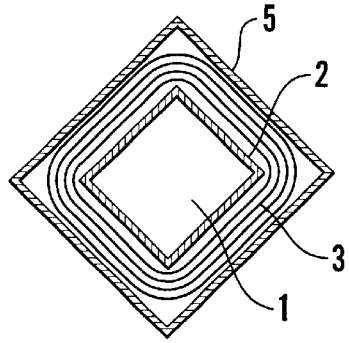
FIG. 4B depicts a plan view of FIG. 4A along line C–C'.
Figure 4C:
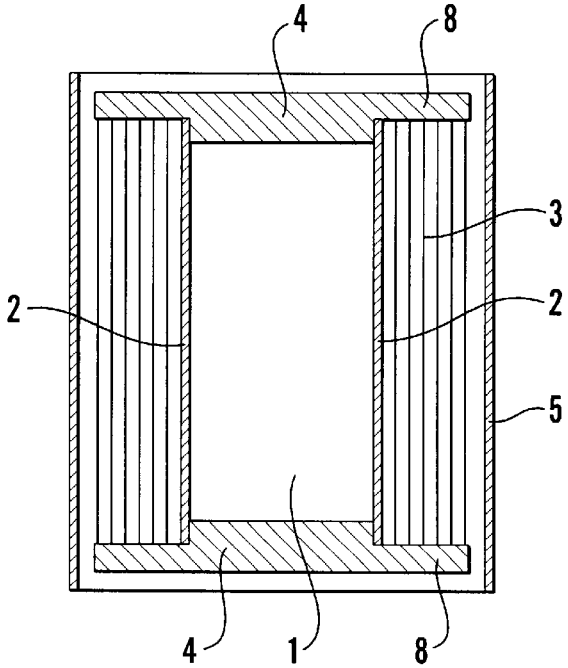
FIG. 4C illustrates an enlarged, cross-sectional view of the container of FIG. 4A in the direction of B–B'.

A collapsible transport container is shown in FIGS. 4A to C that has been fully constructed in its non-collapsed state and has been sealed, and thus is ready for transporting goods (not shown) previously placed within the cavity 1 of the container.

The container comprises a liner 2 that optionally has a rigidity substantially in a direction parallel to a vertical axis C–C' of the container. The container is collapsible, in a direction transecting this vertical axis, between a non-collapsed state, as shown in FIGS. 4A to C, and an at least partially collapsed state, as shown in FIGS. 2A to E and FIG. 3A.

Flexible, elastic insulating material 3 surrounds the liner 2 so as to form sides of the container with two insulating plug(s) 4 inserted inside the liner 2 in its non-collapsed state. Alternatively, the liner 2 itself may be provided with flaps (not shown) at either end, which can be inserted instead of the plugs 4, and which can act as a lid and a base for the container. Such flaps may simply be unitary pieces of material or may be provided in a segmented form so as to form "crash-lock" ends to the container.

When flaps are present, they may be kept in their inserted position by optional locking means, or may be retained simply by bonding the pressure envelope 5 directly to them.

Further, a combination of plugs 4 and flaps may be employed, if desired.

Although containers can be constructed that are collapsible in directions that transect the vertical axis C–C' at various angles, the container shown in the Figures is collapsible in a direction that is perpendicular to the vertical axis.

Figure 1B:
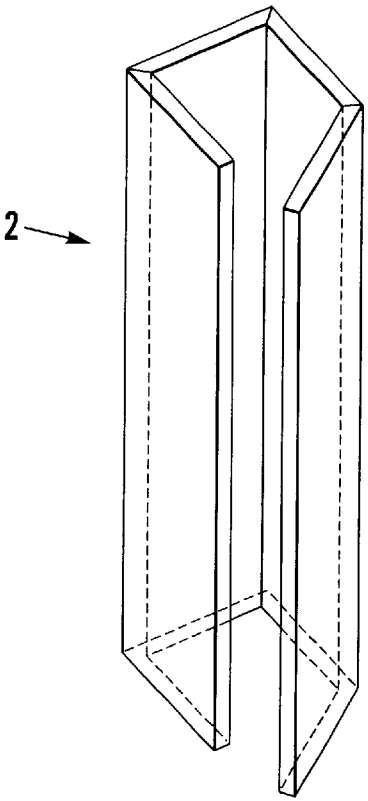
FIGS. 1A and 1B show two perspective views of a liner of a container according to one embodiment of the present invention.
Figure 1A:
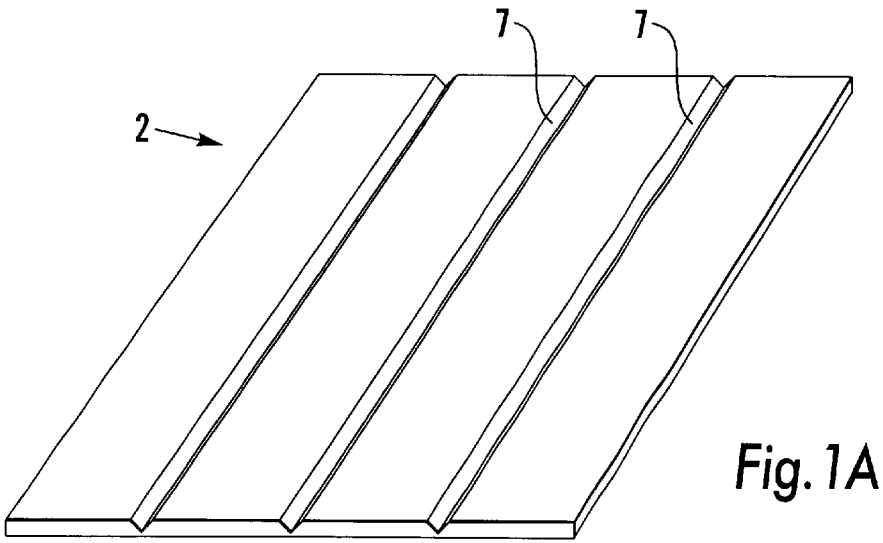

The liner 2 is usually extruded in a flat form and then die stamped to shape (see FIG. 1A). Cardboard liners 2 are then folded and their ends are glued together, whereas plastic ones are creased and the ends are then heat bonded (see FIG. 1B). If such a plastic liner 2 is made of a foam, it can be extruded with integral shallow mitered grooves 7 that allow the liner 2 to be easily folded rather than creased.

Preferred materials for a plastic liner 2 are blown, or solid, low-density polyethylene, polypropylene, nylons and so forth. The plugs 4 may be of similar materials, if desired, although are typically extruded in such a manner as to be more rigid than the walls of the liner 2. Further, the flexible insulating material 3 may also be extruded from the same or similar types of blown plastics as mentioned above.

The material forming the walls of the liner 2 may optionally be corrugated, and examples of such material include corrugated cardboard, corrugated plastic (such as Correx™ and Twinplast™) and so forth.

Typically, the corrugations of such material are fluted in a direction substantially parallel to the horizontal plane containing the line B–B' (see FIG. 4A) of the container. This type of fluting provides the container with substantial rigidity, since in the non-collapsed position the corrugations tend to buckle somewhat. This pushes the corners of the liner 2 outwards, so increasing the tension in the sides of the container. In addition, the presence of the inserted rigid plug(s) 4 provides the container with extra lateral rigidity.

The container's overall rigidity is an important property that enables the transported goods to be insulated from physical shocks during transit. Vertical rigidity is predominantly provided by the rigidity of the walls of the liner 2.

Further, the air trapped within the flutes of the corrugations can also provide a degree of thermal insulation of the goods held within the container.

If desired, the corrugations may be fluted in a direction substantially parallel to the vertical plane containing the line C–C' (see FIG. 4A again).

The transport container shown in FIGS. 4A to C further comprises a heat-shrunk pressure envelope 5 that applies pressure around the exterior of the sides of the container, especially when the container is in its non-collapsed state. Thus, the envelope also contributes to providing the container's overall rigidity.

The flexible insulating material 3 comprises a plurality of layers, which optionally consist of at least one sheet of the material wound a plurality of times around itself. The air trapped within the layers can provide the container with increased properties of insulation. When the material 3 is in the form of a winding, the innermost and outermost edges are typically secured by heat bonding. However as the container changes its shape during opening or flattening, the layers of the winding can still move relative to one another. Thus, if the liner 2 is sufficiently opened and then re-flattened, the container may remain in its non-collapsed state despite the absence of any plug(s) 4. The plugs do, of course, need to be inserted if any contents are to be securely held inside the container.

As shown in FIG. 2E and FIGS. 3A to C, the envelope 5 can comprise loose edges 6 that protrude away from the plurality of layers of flexible insulating material 3. Such loose edges 6 can be bonded (see FIG. 4C) to the plugs. Alternatively, the loose edges 6 can be bonded (not shown) to the edges of the plurality of layers of flexible insulating material 3.

Typically, as mentioned above, at least a portion of an outermost layer of the flexible insulating material 3 is bonded to an adjacent, inner layer of said flexible insulating material 3.

Preferably, the liner 2, the plurality of flexible layers, the plugs 4 and the envelope are made of a convenient thermoplastic, such as a low-density polyethylene. Typically, the envelope 5 is heat-shrinkable for ease of sealing the container. It is particularly preferred for all components to be made of the same thermoplastic.

Although the plugs 4 shown in the Figures are used as container closure means, alternative plugs 4 can be used as content separator means for sub-dividing the cavity 1 into compartments. Dividing the container in this manner can also help give the container extra physical strength to protect any contents during transit.

Figure 5B:
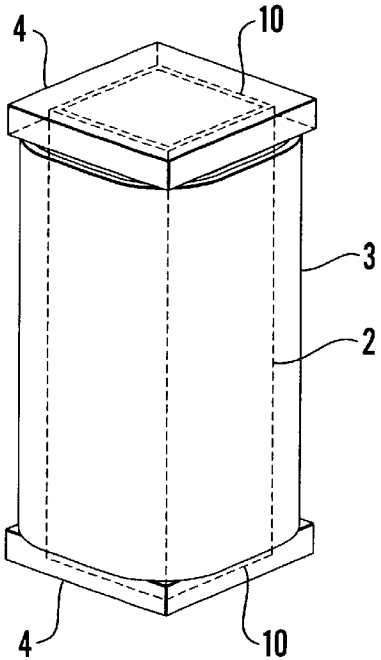
FIG. 5B depicts the container shown in FIG. 5A being capped at both ends by plugs having slits for engagement with the liner.
Figure 5A:
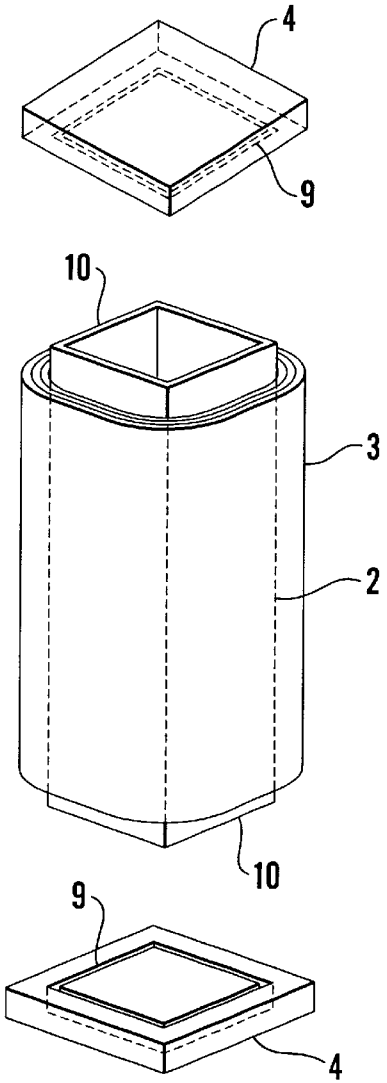
FIG. 5A shows an alternative arrangement of the liner and a wound plurality of layers.

The plugs 4 may be simple disks of material or, as illustrated in the Figures, may be cut into the form of blocks with an outer protruding ledge 8 for closing over the edge of the flexible insulating material 3. However, when relatively simple disks are used, they may be constructed to have slits 9 cut into one of their major surfaces (see FIG. 3), so as to be adapted to receive the ends of the liner 2. In this way (see FIGS. 5A and B), such disks can be used to cap the latent openings at the ends of the liner 2, so as to form a base and lid of the container. This type of arrangement is particularly easy to assemble if the ends 10 of the liner 2 protrude outwards away from the insulation means 3, that is when the latter is shorter in the length than the liner 2.

Preferably, the walls of the liner form a tessellating shape when the liner is in its non-collapsed state. In this way, the outer shape of the fully constructed container filled with goods will allow multiple containers to be packed efficiently together without wasting space during transit.

The container can be assembled (either by its manufacturer or by a subsequent customer) from a kit comprising the following components; at least one of the liners 2, each being surrounded by an amount of flexible insulating material 3; at least one set of plugs 4; and at least one pressure envelope 5.

Figure 2E:
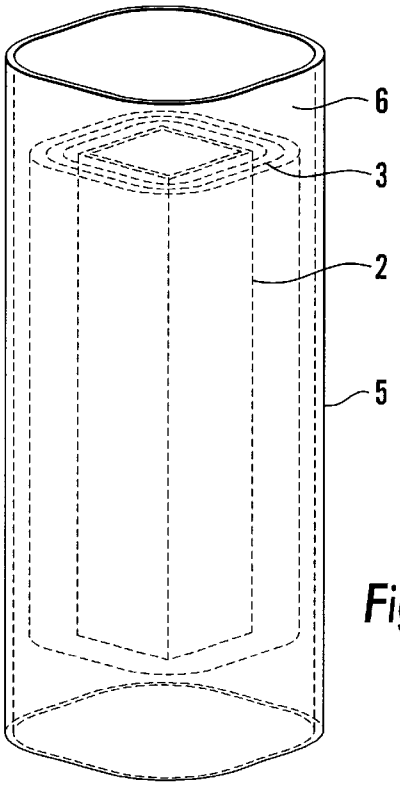
FIGS. 2C and 2E show perspective views of the collapsed liner of FIG. 2A together with a surrounding plurality of layers of flexible insulating material and with a further pressure envelope, respectively.
Figure 2F:
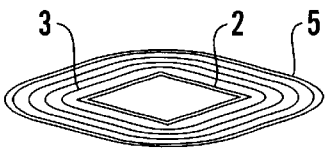
FIGS. 2D and 2F illustrate plan views of the containers shown in FIGS. 2C and 2E respectively.
Figure 2C:
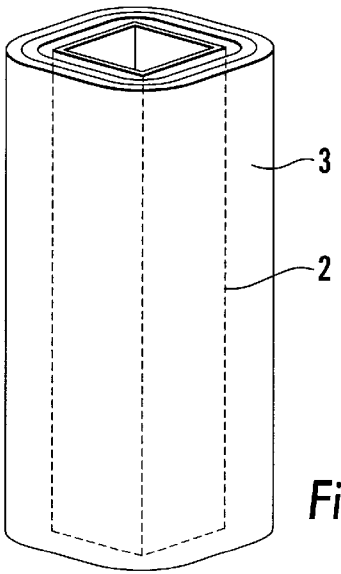
Figure 2D:
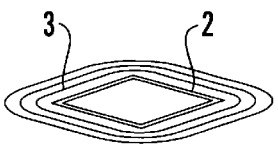
Figure 2A:
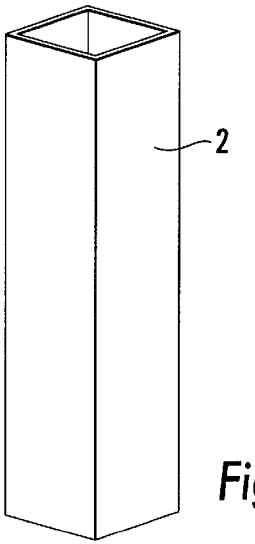
FIG. 2A depicts a perspective view of the liner of FIGS. 1A and 1B after construction and in a collapsed configuration.
Figure 2B:
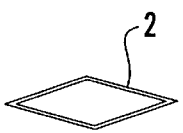
FIG. 2B illustrates a plan view of the liner of FIG. 2A.
Figure 3C:
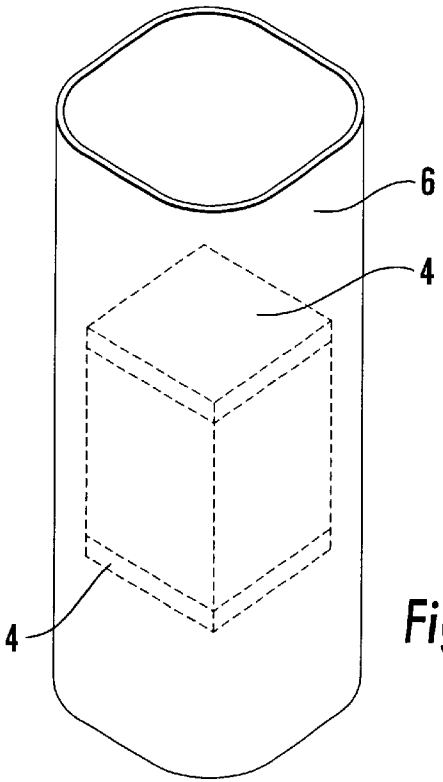
FIGS. 3B and 3C show the container of FIG. 3A in a non-collapsed configuration with top and bottom end plugs in unattached and in attached positions respectively.

The kit, and thus the transport container, can be easily constructed by way of the following method steps which define a procedure that is sequentially illustrated by the accompanying drawings in an order starting from FIG. 2A and finishing at FIG. 3C.

Firstly, a liner 2 is placed in its collapsed state (see FIGS. 2A and B) around a flat mandrel (not shown). Secondly, a plurality of layers of flexible insulation material 3 is wound around the outside of the liner 2 (see FIGS. 2C and D). If a relatively long mandrel is used, multiple container units may be produced at the same time.

Subsequently, the partially constructed container is removed from the flat mandrel and may be supplied in this flattened state. Thus, a manufacturer may supply such a product directly to a customer wishing to transport goods, in a kit form (as mentioned above) that further comprises the required separate plugs 4 and separate pressure envelopes 5.

When a long mandrel is used the long, partial construction that is removed from the mandrel can be cut into separate container units, so that multiple container units can be simultaneously produced.

Figure 3B:
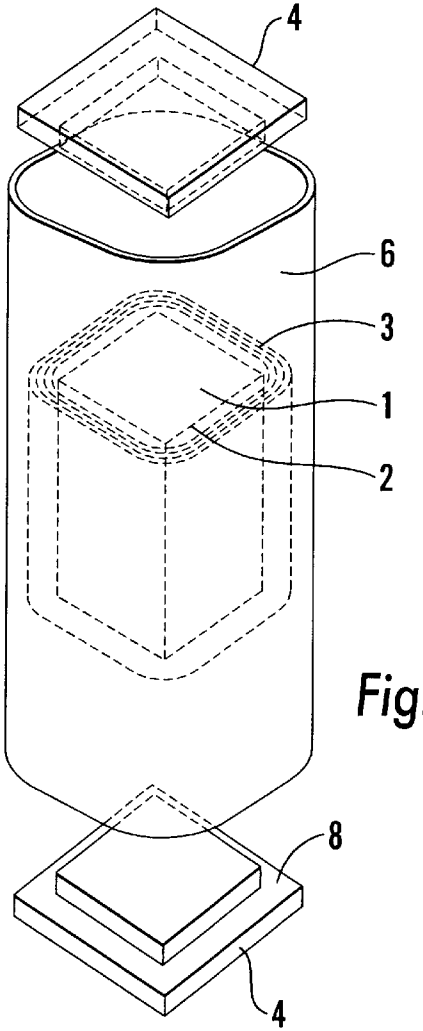
Figure 3A:
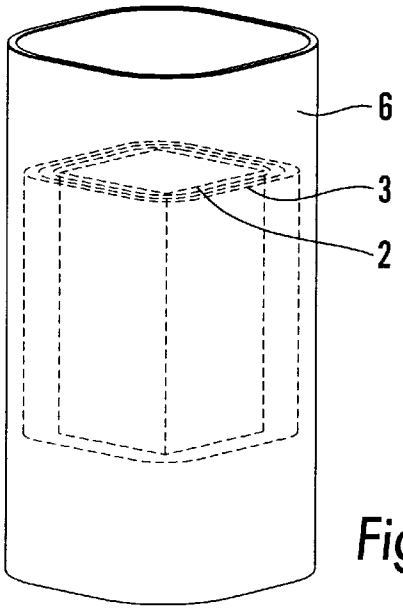
FIG. 3A shows the collapsed container of FIG. 2E.

To assemble the kit, the customer can bond at least part of each pressure envelope 5 around the outside of the plurality of layers of each container with the liners 2 still in their collapsed state (as illustrated in FIGS. 2E and F and FIG. 3A).

Then, after each liner 2 has been opened into its non-collapsed state, plugs 4 can be inserted at each end of the liners 2. This helps to maintain the non-collapsed state of the liner of each container, as shown in FIGS. 3B and C, and the goods can be placed inside the container. Finally, the loose protruding edges 6 of the pressure envelope of each container can be bonded to both plugs 4, so as to seal the contents within the container Preferably, the bonding steps are achieved by heat shrinking, for example when the envelope 5 is also a thermoplastic material. Such an envelope 6 is typically formed as a mono-extrusion of low density polyethylene, polypropylene, nylon and so forth. When the container is subsequently opened into its non-collapsed configuration tension increases in the plurality of layers of flexible material 3 and the envelope 5. The increased tension provides the container with extra rigidity.

Although the Figures only show a four-sided liner 2, any number of liner walls can be employed. In this way, the container need not only be substantially rectangular, but can be generally any shape, including substantially polygonal shapes, as desired, when three or more walls are present.

Thus, a customer can purchase a kit that can be easily assembled into a transport container comprising components composed of a single, re-cyclable material. The assembled container can be efficiently and simply sealed, for example, by using only a single piece of bonding machinery such as a heat-shrinking device.

Advantageously, the resultant transport container is easy to store when it is empty, because it is at least partially collapsible and can therefore be flattened to a compact state. It may also have a space efficient outer shape in its non-collapsed state, so that the number of such containers that may be transported per given transit space can be maximised.

What is claimed:

1. A transport container, comprising:

a rigid liner collapsible, in a direction transecting a vertical axis of the container, such that the container is configurable between a non-collapsed state, in which state it is configured to hold transportable contents, and an at least partially collapsed state, in which state it is configured for compact storage when empty:

elastic insulation surrounding said liner wherein the elastic insulation comprises at least one sheet of flexible material wound a plurality of times around itself to form a plurality of layers; and one or more rigid, insulating plugs configured for insertion inside the liner when the container is in its non-collapsed state.

2. The transport container as claimed in claim 1, wherein the elastic insulation is in a tensioned state so as to tension sides of the container, such a tension increasing when the container is in its non-collapsed state, and wherein the one or more plugs maintain the container in its non-collapsed state when the plugs are inserted into the liner.

3. The transport container as claimed in claim 1, wherein the container is collapsible in a direction perpendicular to the vertical axis of the container.

4. The transport container as claimed in claim 1, wherein the liner comprises corrugated material.

5. The transport container as claimed in claim 1, further comprising:

a pressure envelope configured to apply pressure around an exterior of sides of the container.

6. The transport container as claimed in claim 5, wherein the pressure envelope comprises loose edges protruding away from the at least one sheet of flexible material, said loose edges being bonded or bondable to either the one or more plugs or edges of at least one sheet of flexible material.

7. The transport container as claimed in claim 1, wherein the liner, the at least one sheet of flexible material and/or the one or more plugs are made of a thermoplastic material.

8. The transport container as claimed in claim 1, wherein the one or more plugs are configured as container closures or content separators.

9. The transport container as claimed in claim 1, wherein walls of the liner form a tessellating shape when the liner is in its non-collapsed state.

10. The transport container as claimed in claim 4, wherein the corrugations are fluted in a direction substantially either perpendicular or parallel to the vertical axis of the container.

11. The transport container as claimed in claim 5, wherein the pressure envelope is heat-shrinkable.

12. The transport container as claimed in claim 11, wherein the pressure envelope is formed of a thermoplastic material.

13. The transport container as claimed in claim 12, wherein the thermoplastic material comprises polyethylene.

14. The transport container as claimed in claim 7, wherein the thermoplastic material is a low density polyethylene.

15. The transport container as claimed in claim 14, wherein the low density polyethylene is in the form of a foam.

16. The transport container as claimed in claim 9, wherein walls of the liner have a length in a direction parallel to the vertical axis of the container that is longer than a respective length of the elastic insulation, so that at least an end of the liner protrudes from the elastic insulation.

17. A method of constructing the transport container claimed in claim 1, comprising:

placing said liner in its collapsed state around a flat mandrel;

winding said elastic insulation around an outside of the liner;

removing the partially constructed container from the mandrel;

bonding at least part of a pressure envelope around an outside of the elastic insulation with the liner still in its collapsed state;

opening the liner into its non-collapsed state;

inserting at least one of said one or more plugs inside the liner to maintain the non-collapsed state of the container; and bonding at least another part of the pressure envelope to at least one of said one or more plugs.

18. The method of claim 17, wherein the winding step comprises winding said plurality of layers around the outside of the liner, and wherein the first bonding step comprises bonding at least part of a pressure envelope around an outside of the plurality of layers with the liner still in its collapsed state.

19. The method of claim 17, wherein the first bonding step comprises heat-shrinking at least part of a pressure envelope around an outside of the plurality of layers with the liner still in its collapsed state, and the second bonding step comprises heat-shrinking at least another part of the pressure envelope to at least one of said one or more plugs.

* * * * *